US010988899B2

(12) United States Patent
Pace et al.

(10) Patent No.: US 10,988,899 B2
(45) Date of Patent: Apr. 27, 2021

(54) FLUFF DRYER MACHINE DRAINAGE AID

(71) Applicant: Ecolab USA Inc., St. Paul, MN (US)

(72) Inventors: Luiz Wanderley Bratfisch Pace, Sao Paulo (BR); Gary Samuel Furman, Jr., St. Charles, IL (US); André Messias Krell Pedro, Jundiai (BR); Kraig R. Kent, Dothan, AL (US)

(73) Assignee: ECOLAB USA INC., St. Paul, MN (US)

( * ) Notice: Subject to any disclaimer, the term of this patent is extended or adjusted under 35 U.S.C. 154(b) by 21 days.

(21) Appl. No.: 15/915,445

(22) Filed: Mar. 8, 2018

(65) Prior Publication Data

US 2018/0258591 A1 Sep. 13, 2018

Related U.S. Application Data

(60) Provisional application No. 62/469,300, filed on Mar. 9, 2017.

(51) Int. Cl.

| | |
|---|---|
| ***D21H 21/10*** | (2006.01) |
| ***D21H 17/66*** | (2006.01) |
| ***D21H 17/53*** | (2006.01) |
| ***D21H 17/09*** | (2006.01) |
| ***D21C 9/00*** | (2006.01) |

(52) U.S. Cl.
CPC ..... *D21H 21/10* (2013.01); *D21C 9/005* (2013.01); *D21H 17/09* (2013.01); *D21H 17/53* (2013.01); *D21H 17/66* (2013.01)

(58) Field of Classification Search
CPC ..... D21H 17/06; D21H 17/09; D21H 17/36; D21H 17/53; D21H 17/66; D21H 17/72; D21H 21/10; D21C 9/005
See application file for complete search history.

(56) References Cited

U.S. PATENT DOCUMENTS

| | | | | |
|---|---|---|---|---|
| 3,129,133 | A | 4/1964 | Doyle et al. | |
| 4,529,447 | A | 7/1985 | Okada et al. | |
| 4,959,125 | A | 9/1990 | Spendel | |
| 5,127,994 | A * | 7/1992 | Johansson | D21H 17/59 162/168.3 |
| 5,552,020 | A | 9/1996 | Smith et al. | |
| 6,096,824 | A | 8/2000 | Phan et al. | |
| 6,485,555 | B1 | 11/2002 | Lindgren et al. | |
| 6,565,708 | B2 | 5/2003 | Ikeda et al. | |
| 6,706,144 | B1 | 3/2004 | Furman, Jr. et al. | |
| 8,926,796 | B2 * | 1/2015 | Jogikalmath | D21H 17/72 162/158 |
| 8,999,088 | B2 | 4/2015 | Noishiki et al. | |
| 2003/0024661 | A1 | 2/2003 | Shore et al. | |
| 2005/0274472 | A1 * | 12/2005 | Steif | D21H 21/34 162/159 |
| 2010/0018660 | A1 * | 1/2010 | Varnell | D21H 17/28 162/164.7 |
| 2013/0068409 | A1 | 3/2013 | Pingen | |
| 2013/0160958 | A1 * | 6/2013 | Jogikalmath | D21H 17/72 162/161 |
| 2014/0041818 | A1 | 2/2014 | Sealey et al. | |
| 2014/0360690 | A1 | 12/2014 | Jogikalmath et al. | |
| 2018/0258591 | A1 * | 9/2018 | Pace | D21C 9/005 |

FOREIGN PATENT DOCUMENTS

| | | | | |
|---|---|---|---|---|
| WO | WO 97/31153 | A1 | 8/1997 | |
| WO | WO 02/18704 | A1 | 3/2002 | |
| WO | WO 2005/108669 | A2 | 11/2005 | |
| WO | WO 2013/122731 | A1 | 8/2013 | |
| WO | WO 2016/081819 | A1 | 5/2016 | |
| WO | WO-2018165401 | A1 * | 9/2018 | D21C 9/005 |

OTHER PUBLICATIONS

Smook, G A. In "Handbook for Pulp and Paper Technologists," Angus-Wilde Publications, Second Edition, pp. 220-227. (Year: 1992).*

European Patent Office, International Search Report in International Patent Application No. PCT/US2018/021500, 5 pp. (dated May 23, 2018).

European Patent Office, Written Opinion in International Patent Application No. PCT/US2018/021500, 5 pp. (dated May 23, 2018).

Alexandridis et al., "Poly(ethylene oxide)-poly(propylene oxide)-poly(ethylene oxide) block copolymer surfactants in aqueous solutions and at interfaces: thermodynamics, structure, dynamics, and modeling," *Colloids and Surfaces A: Physicochemical and Engineering Aspects*, vol. 96, pp. 1-46 (1995).

BASF Corporation, "Pluronic® L31: Block Copolymer Surfactant," Technical Bulletin, Florham Park, New Jersey, 1 p. (2004).

BASF Corporation, "Pluronic® Ft L61," Technical Bulletin, Florham Park, New Jersey, 1 p. (2016).

BASF Corporation, "Pluronic® L62," Technical Bulletin, Florham Park, New Jersey, 1 p. (2016).

* cited by examiner

*Primary Examiner* — Jose A Fortuna

(74) *Attorney, Agent, or Firm* — Eric D. Babych; Barnes & Thornburg LLP

(57) ABSTRACT

Methods and compositions useful for improving drainage in a fluff pulp drying process are provided. The methods and compositions comprise alkyl ether sulfate and ethylene oxide/propylene oxide copolymer. In particular, the methods and compositions can improve drainage of fluff pulp in fluff pulp drying processes.

20 Claims, No Drawings

FLUFF DRYER MACHINE DRAINAGE AID

This application is a nonprovisional application claiming the benefit of U.S. Provisional Patent Application Ser. No. 62/362,924, filed Jul. 15, 2016, the disclosure of which is incorporated herein by reference in its entirety.

TECHNICAL FIELD

The present application relates to aiding drainage (i.e., dewatering) in a fluff pulp drying process.

BACKGROUND OF THE INVENTION

Generally, paper pulps are characterized in the industry as paper-grade pulps, dissolving pulps, or fluff pulps. Fluff pulp is a type of pulp generally prepared from wood having long fibers. Fluff pulp is commonly used for products requiring absorbency or moisture protection because fluff pulp is generally hydrophilic. For example, products such as diapers, sanitary napkins, incontinence pads, baby wipes, and medical gowns are typically manufactured from fluff pulp. Accordingly, products manufactured from fluff pulp should have relatively good absorbency, absorption rate, and wet strength as compared to, for example, products manufactured from paper-grade pulp.

The cooking and bleaching of chemical fluff pulps do not significantly differ from the production of paper pulps. However, the web formation, wet pressing, and drying of fluff pulps differ from the production of paper pulp. Generally, fluff pulp is prepared on a pulp drying machine having a wet-end comprising a wire and a press section and a drying section. Generally, fluff pulp is dried on a drying machine such as, for example, a Fourdrinier machine. In a Fourdrinier machine, the pulp (e.g., fluff pulp) is deposited from a headbox onto a continuous, moving open mesh fabric. The water in the slurry drains through the fabric, thus forming a pulp mat. After the initial free drainage through the fabric or wire, the mat is further dewatered as it is carried on the wire by the application of progressively increasing vacuum. The vacuum is applied to the underside of the mat by a series of elements known as vacuum boxes. After drying, the pulp is typically wound onto rolls. The resulting product usually has a moisture content of from about 5% to about 10% by weight.

BRIEF SUMMARY OF THE INVENTION

A method of treating a fluff drying process is provided. The method comprises treating fluff pulp with alkyl ether sulfate and polyethylene oxide/polypropylene oxide copolymer. In certain embodiments of the method, the alkyl ether sulfate is a compound of formula (I):

formula (I)

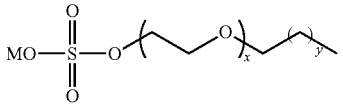

wherein x is an integer of from 1 to 10, y is an integer of from 0 to 20, and M is hydrogen, an ammonium-containing moiety, or a metal.

Additionally, a fluff pulp product is provided. The fluff pulp product comprises fluff pulp, alkyl ether sulfate and polyethylene oxide/polypropylene oxide copolymer.

DETAILED DESCRIPTION OF THE INVENTION

The present disclosure provides methods and compositions for improving drainage of a fluff pulp drying process. It has been discovered that alkyl ether sulfonate and polyethylene oxide/polypropylene oxide copolymer provide beneficial properties related to drainage of fluff pulp processes. For example, when added to the wet end of a fluff pulp drying process, alkyl ether sulfonate and polyethylene oxide/polypropylene oxide copolymer improve drainage of water from fluff pulp in a fluff drier machine. The methods provided herein have been shown to reduce moisture content in fluff pulp in various locations in a pulp drier machine, and improve physical properties of the fiber, such as water absorption and refining. The use of alkyl ether sulfonate and polyethylene oxide/polypropylene oxide copolymer has been shown to provide a more energy-efficient drying process.

A method of treating a fluff pulp drying process is provided. The method comprises treating fluff pulp with alkyl ether sulfate and polyethylene oxide/polypropylene oxide copolymer. In certain embodiments of the methods provided herein, the fluff pulp that is treated is a fluff pulp furnish. Fluff pulp furnish describes the slurry of fluff pulp, water, and optionally other components that are present in or delivered to a headbox.

In certain embodiments of the methods provided herein, the fluff pulp is treated with a single formulation comprising the alkyl ether sulfate and a polyethylene oxide/polypropylene oxide copolymer. In other words, the alkyl ether sulfate and the polyethylene oxide/polypropylene oxide copolymer may be present in a single formulation. In certain embodiments of the methods provided herein, the single formulation is an aqueous solution.

In certain embodiments of the methods provided herein, the alkyl ether sulfate is a compound of formula (I)

formula (I)

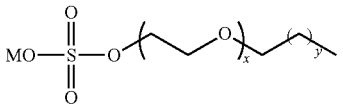

wherein x is an integer of from 1 to 10, y is an integer of from 0 to 20, and M is hydrogen, an ammonium-containing moiety, or a metal. The x may be an integer of 2 or more, or 3 or more. The y may be an integer of 5 or more, 8 or more, or 10 or more. In certain embodiments of the methods provided herein, the M is a metal. In certain embodiments of the methods provided herein, the M is an ammonium-containing moiety. In certain embodiments of the methods provided herein, x is 3, y is an integer of 10 or more, and M is a metal.

In certain embodiments of the methods provided herein, when the M is a metal, the metal is an alkali metal or an alkaline earth metal. In certain embodiments of the methods provided herein, the metal is sodium, potassium, lithium, magnesium, or calcium.

In certain embodiments of the methods provided herein, when M is an ammonium-containing moiety, the ammonium-containing moiety is selected from ammonium (i.e., $NH_4^+$), hydroxyethylammonium, di(hydroxyethyl)ammonium, and tri(hydroxyethyl)ammonium.

In certain embodiment of the methods provided herein, the alkyl ether sulfate is ammonium laureth sulfate, ammonium myreth sulfate, sodium myreth sulfate, sodium trideceth sulfate, or a combination thereof. In certain embodiments of the methods provided herein, the alkyl ether sulfate is lauryl ether sulfate or laureth sulfate. In certain embodiments of the methods provided herein, the alkyl ether sulfate is sodium laureth sulfate.

The polyethylene oxide/polypropylene oxide copolymer may be of any suitable molecular weight. In certain embodiment of the methods provided herein, the polyethylene oxide/polypropylene oxide copolymer has a weight average molecular weight of from about 1150 Daltons to about 5000 Daltons. Thus, in certain embodiments of the methods provided herein, the polyethylene oxide/polypropylene oxide copolymer has a weight average molecular weight of from about 1150 to about 5000 Daltons, from about 1200 to about 5000 Daltons, from about 1250 to about 5000 Daltons, from about 1300 to about 5000 Daltons, from about 1400 to about 5000 Daltons, from about 1200 to about 4000 Daltons, from about 1200 to about 3500 Daltons, from about 1200 to about 3000 Daltons, from about 1200 to about 2500 Daltons, from about 1200 to about 2000 Daltons, from about 1200 to about 1750 Daltons, from about 1150 to about 2500 Daltons, from about 1150 to about 2000 Daltons, from about 1300 to about 4000 Daltons, from about 1400 to about 4000 Daltons, from about 1300 to about 3000 Daltons, from about 1300 to about 2500 Daltons, or from about 1500 to about 3000 Daltons.

In certain embodiments, the method further comprises treating the fluff pulp with a debonder. In certain embodiments of the methods provided herein, a debonder is a cationic surfactant. A debonder may be, for example, a quaternary ammonium compound having one or more fatty alkyl groups, e.g., for example, an organic quaternary salt having fatty chains of about 12 to about 22 carbon atoms. Examples of debonders include, but are not limited to, dialkyl imidazolinium quaternary salt, dialkyl diamidoamine quaternary salt, monoalkyl trimethylammonium quaternary salt, dialkyl dimethylammonium quaternary salt, trialkylmonomethylammonium quaternary salt, ethoxylated quaternary salt, dialkyl ester quaternary salt, trialkyl ester quaternary salt, and the like. In certain embodiments of the methods provided herein, the fluff pulp is treated with a single formulation comprising the debonder, the alkyl ether sulfate, and the polyethylene oxide/polypropylene oxide copolymer. In certain embodiments of the methods provided herein, the fluff pulp is treated with the debonder prior to, simultaneously as, or after the fluff pulp is treated with the alkyl ether sulfate and the polyethylene oxide/polypropylene oxide copolymer.

In certain embodiments of the methods provided herein, the method further comprises treating the fluff pulp with a drainage aid other than the alkyl ether sulfate and the polyethylene oxide/polypropylene oxide copolymer. In certain embodiments, the drainage aid other than alkyl ether sulfate and polyethylene oxide/polypropylene oxide copolymer comprises polyaluminum chloride, aluminum sulfate, a polyamine, and/or a polyacrylamide. In certain embodiments of the methods provided herein, the fluff pulp is treated with a single formulation comprising the alkyl ether sulfate, the polyethylene oxide/polypropylene oxide copolymer, and a drainage aid other than the alkyl ether sulfate and the polyethylene oxide/polypropylene oxide copolymer. In certain embodiments of the methods provided herein, the fluff pulp is treated with a single formulation comprising aluminum sulfate, the alkyl ether sulfate, and the polyethylene oxide/polypropylene oxide copolymer. In certain embodiments of the methods provided herein, the fluff pulp is treated with aluminum sulfate prior to, simultaneously as, or after the fluff pulp is treated with the alkyl ether sulfate and the polyethylene oxide/polypropylene oxide copolymer.

In certain embodiments, the method further comprises treating the fluff pulp with a debonder as provided herein. In certain embodiments, the method further comprises treating the fluff pulp with a debonder and aluminum sulfate as provided herein.

The fluff pulp may be treated with any suitable amounts of alkyl ether sulfate and polyethylene oxide/polypropylene oxide copolymer. In certain embodiments of the methods provided herein, the fluff pulp is treated with alkyl ether sulfate and polyethylene oxide/polypropylene oxide copolymer at an alkyl ether sulfate-to-polyethylene oxide/polypropylene oxide copolymer ratio (i.e., aes-to-copolymer ratio) of from about 1:3 to about 100:1. Thus, in certain embodiments of the methods provided herein, the fluff pulp is treated with alkyl ether sulfate and polyethylene oxide/polypropylene oxide copolymer at an aes-to-copolymer ratio of from about 1:3 to about 100:1, from about 2:3 to about 100:1, from about 1:1 to about 100:1, from about 2:1 to about 100:1, from about 3:1 to about 100:1, from about 1:1 to about 50:1, from about 1:1 to abut 20:1, from about 1:1 to about 10:1, from about 2:1 to about 50:1, from about 2:1 to about 20:1, from about 2:1 to about 10:1, from about 3:1 to about 50:1, form about 3:1 to about 20:1, from about 3:1 to about 10:1, from about 4:1 to about 50:1, from about 4:1 to about 20:1, from about 4:1 to about 10:1, or from about 5:1 to about 50:1. In certain embodiments of the methods provided herein, the fluff pulp is treated with alkyl ether sulfate and polyethylene oxide/polypropylene oxide copolymer at an aes-to-copolymer ratio of from about 1:1 or greater. In certain embodiments of the methods provided herein, the fluff pulp is treated with alkyl ether sulfate and polyethylene oxide/polypropylene oxide copolymer at an aes-to-copolymer ratio of from about 2:1 or greater. In certain embodiments of the methods provided herein, the fluff pulp is treated with alkyl ether sulfate and polyethylene oxide/polypropylene oxide copolymer at an aes-to-copolymer ratio of from about 3:1 or greater.

A fluff pulp product is provided. In certain embodiments, the fluff pulp product comprises alkyl ether sulfate and polyethylene oxide/polypropylene oxide copolymer as provided herein.

The fluff pulp may be treated with alkyl ether sulfate and polyethylene oxide/polypropylene oxide copolymer at any suitable stage in the fluff pulp drying process. In certain embodiments of the methods provided herein, the fluff pulp is treated with alkyl ether sulfate and polyethylene oxide/polypropylene oxide copolymer at the wet end of a fluff pulp drying process. In certain embodiments of the methods provided herein, the fluff pulp is treated with alkyl ether sulfate and polyethylene oxide/polypropylene oxide copolymer upstream from or at a headbox. In certain embodiments of the methods provided herein, the fluff pulp has a consistency of from about 1% to about 4%. In certain embodiments of the methods provided herein, the fluff pulp is treated with alkyl ether sulfate and polyethylene oxide/polypropylene oxide copolymer after mat formation and upstream of an evaporative drying section. In certain embodiments of the methods provided herein, the fluff pulp is treated with alkyl ether sulfate and polyethylene oxide/polypropylene oxide copolymer prior to contact with a dryer.

The fluff pulp product can be any article that comprises fluff pulp. In certain embodiments, the fluff pulp product is a personal absorbance product (e.g., a baby diaper, an adult diaper, a feminine pad, etc.), a facial wipe, a baby wipe, or a medical wear.

EXAMPLES

The following examples further illustrate the invention but, of course, should not be construed as in any way limiting its scope. For Examples 1 and 2 shown below, the following procedure was followed to arrive at the data shown in Tables I-III herein.

A portion of fluff pulp slurry was removed from a headbox. Temperature of the portion was measured to determine if the temperature of the portion was approximately the temperature of a fluff pulp-papermaking forming section. The sample was transferred to a container equipped with a mechanical stirring device and a valved bottom opening (hereinafter "the distributor"). The sample was stirred so as to provide a reasonable amount of homogenization in the fluff pulp slurry contained therein.

For each sample shown in Examples 1 and 2, an aliquot of approximately 500 mL of fluff pulp slurry was removed from the distributor, and the weight of the aliquot was recorded. Using a thermostatic water bath, the aliquot was heated to process temperature, which was from about 50° C. to about 75° C. for the samples of Examples 1 and 2.

A Büchner funnel was equipped with a section of representative fluff tissue paper machine forming wire and a bottomless graduated cylinder, such that the graduated cylinder fit over the top of the Büchner funnel to provide additional head space above the Büchner funnel. The Büchner funnel was stoppered on a vacuum flask, which was operably attached to a vacuum pump. When operated, the vacuum pump provided suction so as to replicate a vacuum box of a fluff pulp-papermaking dryer machine. In Examples 1 and 2, the initial vacuum suction was set at about 400 mmHg.

Prior to dosing the dewatering agent, the aliquot was mixed and its temperature is measured and recorded. Except for control samples, a dewatering agent was added to the aliquot (dewatering agent diluted, if necessary for dissolution purposes, 1:5 by volume in water). The sample (i.e., aliquot+dewatering agent) was then mixed.

The sample was then transferred to the bottomless cylinder without applying vacuum to the vacuum flask. The process of the sample passing through the funnel without vacuum proceeded for 10 seconds, at which point vacuum was applied to the flask. The separation proceeded under vacuum for 1 minute, 20 seconds, (total time of separation: 1 minute, 30 seconds). The maximum and minimum vacuum values during vacuum application were recorded from the vacuum pump. The total amount of filtrate was recorded (weight and/or volume), and the fluff pulp "cake" was dried in an oven at 105° C. until constant weight. Data was analyzed to determine the amount of water removed. Further conditions during Examples 1 and 2 are summarized in Table I below.

TABLE I

Conditions for Fluff Pulp Drainage Tests described in Examples 1 and 2.

| | |
|---|---|
| Pulp consistency | 2% |
| Temperature | 60° C. |

TABLE I-continued

Conditions for Fluff Pulp Drainage Tests described in Examples 1 and 2.

| | |
|---|---|
| Initial Vacuum | About 400 mmHg |
| Drainage Time (settling + vacuum) | 10 sec, total: 1:30 minutes |
| Pulp suspension pH | 6.6 |
| pH after debonder addition | 6.8 |
| pH after debonder and $Al_2(SO_4)_3$ addition | 4 |

Example 1

This Example demonstrates drainage of fluff pulp in the presence of various ingredients in accordance with an embodiment of the invention.

TABLE II

Fluff Pulp Drainage Results

| Sample | AES (for the relevant samples listed below, lauryl ether sulfate): EO/PO polymer (concentration) | Debonder | $Al_2(SO_4)_3$ | Solids (%) | Final Vacuum (mmHg) |
|---|---|---|---|---|---|
| 1 (comparative) | — | — | — | 25.2 | −120 |
| 2 (comparative) | — | 1 Kg/ton | — | 23.5 | −110 |
| 3 (comparative) | — | 1 Kg/ton | 4.0 Kg/ton | 24.1 | −110 |
| 4 | 3:1 (500 ppm) | 1 Kg/ton | 4.0 Kg/ton | 23.3 | −175 |
| 5 | 1:3 (500 ppm) | 1 Kg/ton | 4.0 Kg/ton | 24.1 | −110 |
| 6 | 3:1 (500 ppm) | 1 Kg/ton | — | 26.1 | −200 |
| 7 | 3:1 (500 ppm) | — | — | 28.4 | −380 |
| 8 | 1:1 (500 ppm) | — | — | 26.3 | −350 |
| 9 | 1:3 (500 ppm) | — | — | 26.7 | −270 |
| 10 (comparative) | — | 1 Kg/ton | 4.0 Kg/ton | 24.2 | −120 |

Example 2

This Example demonstrates drainage of fluff pulp in the presence of various ingredients in accordance with an embodiment of the invention.

TABLE III

Fluff Pulp Drainage Results

| Sample | AES (for the relevant samples listed below, lauryl ether sulfate): EO/PO polymer (concentration) | AES (for the relevant samples listed below, lauryl Alcohol 7EO): EO/PO polymer (concentration) | Debonder | Solids (%) | Filtrate weight (g) | Final Vacuum (mmHg) |
|---|---|---|---|---|---|---|
| 1 (comparative) | — | — | — | 23.5 | 454.0 | −100 |
| 2 (comparative) | — | — | Debonder (1 kg/ton) | 22.4 | 452.6 | −100 |
| 3 | 3:1 (500 ppm) | — | — | 27.7 | 460.9 | −290 |
| 4 | 1:1 (500 ppm) | — | — | 27.9 | 462.8 | −330 |
| 5 | 1:3 (500 ppm) | — | — | 26.1 | 460.0 | −250 |
| 6 | — | 3:1 (500 ppm) | — | 25.2 | 459.6 | −170 |
| 7 | — | 1:1 (500 ppm) | — | 25.0 | 457.4 | −140 |
| 8 | — | 1:3 (500 ppm) | — | 24.5 | 455.0 | −120 |
| 9 | 3:1 (500 ppm) | — | Debonder (1 kg/ton) | 27.5 | 461.5 | −340 |
| 10 | — | 3:1 (500 ppm) | Debonder (1 kg/ton) | 25.7 | 462.6 | −200 |

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Embodiments of this invention are described herein, including the best mode known to the inventors for carrying out the invention. Variations of these embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A method for improving drainage of water from wet fluff pulp in a fluff pulp drying process which involves draining water from fluff pulp, the method comprising:

treating the wet fluff pulp with an alkyl ether sulfate and a polyethylene oxide/polypropylene oxide copolymer in an amount of from about 500 ppm to about 1000 ppm to improve drainage of water from the fluff pulp in the process, wherein the ratio of alkyl ether sulfate to polyethylene oxide/polypropylene oxide copolymer is from about 1:3 to about 4:1.

2. The method of claim 1, wherein the alkyl ether sulfate is a compound of formula (I)

formula (I)

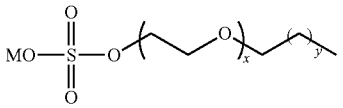

wherein x is an integer of from 1 to 10, y is an integer of from 0 to 20, and M is hydrogen, an ammonium-containing moiety, or a metal.

3. The method of claim 2, wherein x is 3, y is an integer of 10 to 20, and M is a metal.

4. The method of claim 2, wherein the alkyl ether sulfate and the polyethylene oxide/polypropylene oxide copolymer are added to the fluff pulp at a wet end of a fluff pulp drying process.

5. The method of claim 2, wherein the alkyl ether sulfate and the polyethylene oxide/polypropylene oxide copolymer are added to the fluff pulp upstream from or at a headbox.

6. The method of claim 2, wherein the alkyl ether sulfate and the polyethylene oxide/polypropylene oxide copolymer are added to the fluff pulp after mat formation and upstream of an evaporative drying section.

7. The method of claim 1, wherein the alkyl ether sulfate is lauryl ether sulfate.

8. The method of claim 1, wherein the polyethylene oxide/polypropylene oxide copolymer has a weight average molecular weight of from about 1200 Daltons to about 4000 Daltons.

9. The method claim 1, wherein the alkyl ether sulfate and the polyethylene oxide/polypropylene oxide copolymer are added to the fluff pulp at an alkyl ether sulfate-to-polyethylene oxide/polypropylene oxide copolymer weight ratio of from about 2:1 to about 4:1.

10. The method of claim 1, wherein the alkyl ether sulfate and the polyethylene oxide/polypropylene oxide copolymer are added to the fluff pulp at an alkyl ether sulfate-to-polyethylene oxide/polypropylene oxide copolymer weight ratio of from about 2:3 to about 4:1.

11. The method of claim 1, wherein the alkyl ether sulfate and the polyethylene oxide/polypropylene oxide copolymer are added to the fluff pulp at a wet end of a fluff pulp drying process.

12. The method of claim 1, wherein the alkyl ether sulfate and the polyethylene oxide/polypropylene oxide copolymer are added to the fluff pulp upstream from or at a headbox.

13. The method of claim 1, wherein the alkyl ether sulfate and the polyethylene oxide/polypropylene oxide copolymer are added to the fluff pulp after mat formation and upstream of an evaporative drying section.

14. The method of claim 1, further comprising treating the fluff pulp with a drainage aid other than the alkyl ether sulfate and the polyethylene oxide/polypropylene oxide copolymer.

15. The method of claim 14, wherein the further drainage aid comprises aluminum sulfate.

16. The method of claim 1, further comprising treating the fluff pulp with a debonder.

17. The method of claim 1, wherein the alkyl ether sulfate and the polyethylene oxide/polypropylene oxide copolymer are present in a single formulation.

18. The method of claim 17, wherein the single formulation is an aqueous solution.

19. A method for improving drainage of water from wet fluff pulp in a fluff pulp drying process which involves draining water from fluff pulp, the method comprising:

treating the wet fluff pulp with an alkyl ether sulfate and a polyethylene oxide/polypropylene oxide copolymer in an amount of from about 500 ppm to about 1000 ppm to improve drainage of water from the fluff pulp in the process, wherein the ratio of alkyl ether sulfate to polyethylene oxide/polypropylene oxide copolymer is from about 1:3 to about 3:1, wherein the alkyl ether sulfate is lauryl ether sulfate.

20. A fluff pulp product comprising fluff pulp, alkyl ether sulfate and polyethylene oxide/polypropylene oxide copolymer in amount from about 500 ppm to 1000 ppm, wherein the ratio of alkyl ether sulfate to polyethylene oxide/polypropylene oxide copolymer is from about 1:3 to about 4:1.

* * * * *